US007118101B2

(12) United States Patent
Frank et al.

(10) Patent No.: US 7,118,101 B2
(45) Date of Patent: Oct. 10, 2006

(54) DEVICE AND METHOD FOR THE INPUT AND STORAGE OF BANKNOTES

(75) Inventors: Ulrich Frank, Eichenau (DE); Xaver Thum, Wolfratshausen (DE); August Haeusler, Wolfratshausen (DE)

(73) Assignee: Giesecke & Devrient GmbH, Munich (DE)

( * ) Notice: Subject to any disclaimer, the term of this patent is extended or adjusted under 35 U.S.C. 154(b) by 154 days.

(21) Appl. No.: 10/476,604

(22) PCT Filed: Apr. 30, 2002

(86) PCT No.: PCT/EP02/04778

§ 371 (c)(1),
(2), (4) Date: Mar. 9, 2004

(87) PCT Pub. No.: WO02/090229

PCT Pub. Date: Nov. 14, 2002

(65) Prior Publication Data

US 2004/0135308 A1 Jul. 15, 2004

(30) Foreign Application Priority Data

May 4, 2001 (DE) ..... 101 21 835

(51) Int. Cl.
*B65H 5/22* (2006.01)

(52) U.S. Cl. ..... 271/3.03; 902/9

(58) Field of Classification Search ..... 271/3.01; 905/9

See application file for complete search history.

(56) References Cited

U.S. PATENT DOCUMENTS

| | | | | |
|---|---|---|---|---|
| 4,363,584 A | * | 12/1982 | Kokubo | 414/788.5 |
| 4,431,178 A | | 2/1984 | Kokubo et al. | |
| 4,511,133 A | | 4/1985 | Kokubo et al. | |
| 4,594,043 A | | 6/1986 | Kawano et al. | |
| 4,825,378 A | | 4/1989 | Yuge | |
| 4,866,254 A | * | 9/1989 | Okayama et al. | 235/379 |

FOREIGN PATENT DOCUMENTS

| | | |
|---|---|---|
| DE | 33 03 845 A1 | 10/1983 |
| DE | 33 46 004 C2 | 7/1984 |
| EP | 0 613 107 B1 | 8/1994 |
| JP | 63-189363 | 8/1988 |
| WO | WO 01/97182 A1 | 12/2001 |

* cited by examiner

*Primary Examiner*—Donald P. Walsh
*Assistant Examiner*—Kenneth W. Bower
(74) *Attorney, Agent, or Firm*—Rothwell, Figg, Ernst & Manbeck, PC

(57) ABSTRACT

An apparatus and method for inputting and depositing bank notes, whereby checked bank notes are temporarily stored in a stacking device singly or in bundles. To permit secure transport of bank notes from a stacking position to an end cashbox, temporarily stored bank notes are stacked on a deposit surface that is then itself moved to a position associated with the end cashbox, so that bank notes can be deposited in the end cashbox in said position.

15 Claims, 7 Drawing Sheets

DEVICE AND METHOD FOR THE INPUT AND STORAGE OF BANKNOTES

This application is a §371 of PCT Application Ser. No. PCT/EP02/04778, filed Apr. 30, 2002.

This invention relates to an apparatus and method for inputting and depositing bank notes whereby checked bank notes are stored temporarily in a stacking device singly or in bundles.

Such an apparatus and method are known for example from EP0 613 107 B1. Checked bank notes are stacked here by a spiral slot stacker on a cover plate of a first cassette and stored temporarily. Then usually at least a portion of the bank notes located in this position acting as an escrow is transported for final deposit to a second cassette laterally offset from the first cassette. For this purpose, the bank notes temporarily stacked on the cover above the first cassette are pushed by a frame from the cover of the first cassette serving as a stacking surface laterally toward the second cassette into which they fall freely.

However, this known system has the following disadvantage. Since bank notes are pushed laterally by the frame from the stacking position above the first cassette, the pushing force emanating therefrom can lead to deformation and, in particular upon stacking of differently dimensioned bank notes, to tilting of the bank-note stack upon pushing. Since the bank notes then fall freely into the second cassette anyway, this is basically unproblematic in the known apparatus.

However, it would prove disadvantageous when the original stacking order is to be retained upon deposit in the end cashbox. This is impossible in the known apparatus.

On these premises, it is the problem of the present invention to provide an apparatus for inputting and depositing bank notes that, while having a simple structure, allows transport of a bank-note stack to an end cashbox, such as an end cassette, whereby the original stacking order can be retained with a high degree of certainty. Moreover, a further problem is to provide an associated bank-note input and deposit method.

To prevent the bank-note stack from slipping when the deposit surface is pulled away in this position associated with the end cashbox, the clamping element can either ensure further fixation or, alternatively, the bank notes are fixed in position by an additional retaining element when the deposit surface is pulled away.

Said retaining element can e.g. be mounted firmly and with an invariable position in the area of the end cassette such that when the deposit surface is pulled away the stack is retained on the retaining element in its given position, e.g. immediately above the cassette opening. Alternatively, said retaining element can e.g. also be a component of the stack carrier unit itself, being fixed in its retaining position for example by a mechanical lock in the position associated with the end cassette while the deposit surface of the stack carrier unit is displaced relative thereto, thereby decoupling said two components of the stack carrier unit in said end cassette position.

To permit especially secure insertion of bank notes into an end cassette while retaining the original stacking order, a stamp element will advantageously be present for stamping bank notes located in the second position into the cassette.

Hereinafter a few further embodiments will be explained and described in more detail by way of example with consideration of the enclosed drawings, in which.

Figure 1:
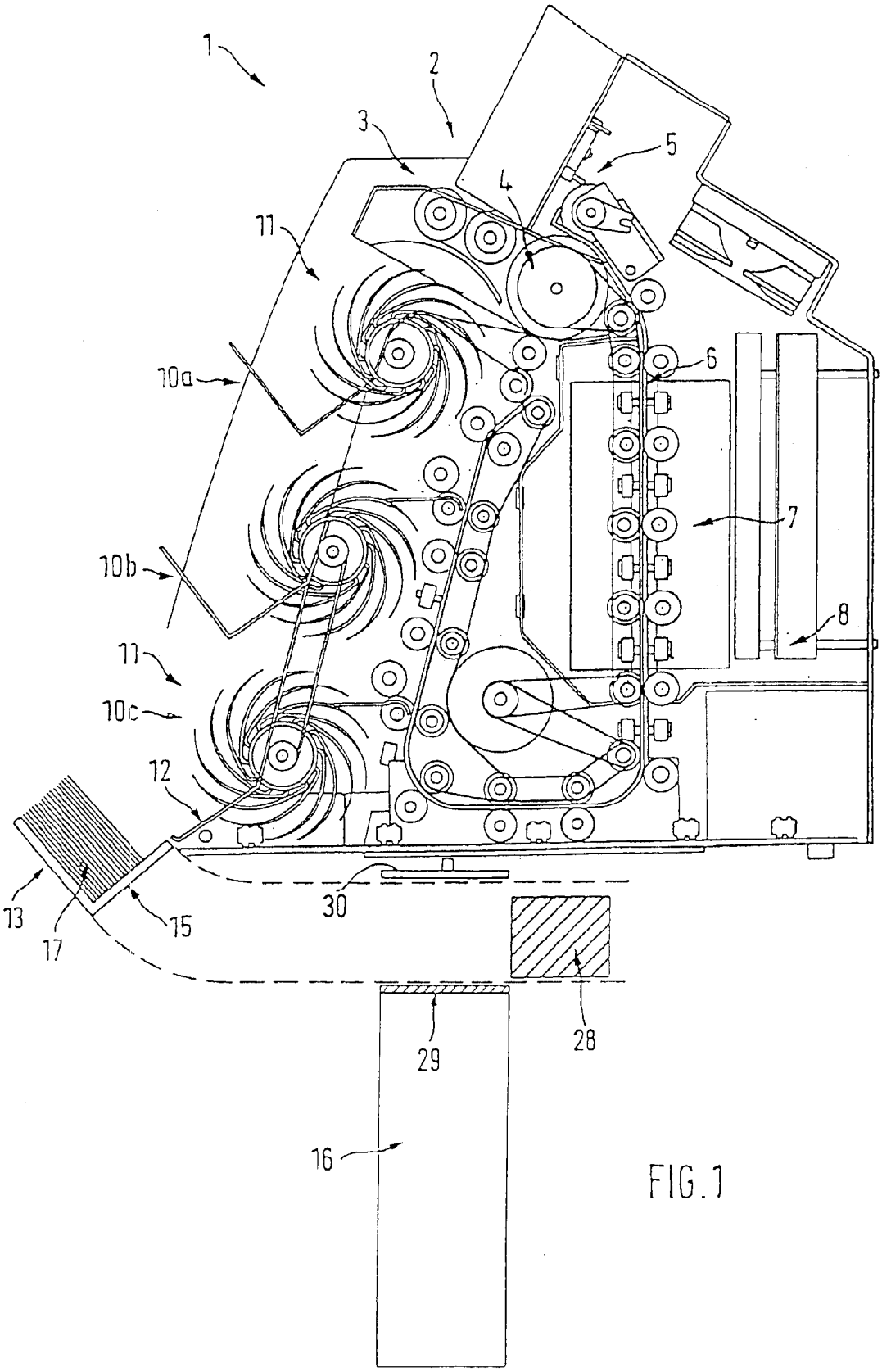
FIG. 1 shows a schematic cross-sectional view of an apparatus according to the present invention, in a first operating state.

A first embodiment of an inventive apparatus is shown in FIGS. 1–4. As to be recognized in particular in FIGS. 1 and 2, which show the apparatus in two different operating states, apparatus 1 has inter alia the following features.

Apparatus 1 is for depositing cash, in particular also for inputting and depositing bank notes. For this purpose, apparatus 1 comprises input pocket 2 for bank notes consisting of feed wheels 3, singling cylinder 4 and retaining wheel 5 serving to single bank notes inputted into pocket 2. Singled bank notes are guided by roller transport path 6 through checking unit 7 having a plurality of sensor modules 7 and transported to deposit area 9. Sensor modules 7 serve to check physical properties of bank notes transported through, in particular to check the authenticity and denomination of bank notes. Deposit area 9 consists of three stacking devices 10*a*–*c* with spiral slot stacker wheels 11 to which single bank notes are supplied via associated diverters in dependence on the results of the check.

Although other uses are also conceivable, the case described by way of example will be that uppermost stacking device 10*a* of the three is used for outputting reject bank notes not recognized in checking unit 7, middle stacking device 10*b* for depositing false bank notes or suspected forgeries, and lowermost stacking device 10*c* for depositing all further bank notes, i.e. for bank notes whose authenticity was confirmed and denomination determined.

Lowermost stacking device 10*c* acts here as an escrow in which authentic bank notes are stored temporarily before final deposit in end cashbox 16 or return to the operator. The shown apparatus is characterized in particular also in that the transport device between escrow and end cashbox is itself a part of stacking device 10*c*.

Stacking device 10*c* comprises for this purpose not only spiral slot stacker 11 with stripping element 12 but also stack carrier unit 13. Stack carrier unit 13, whose construction for a first embodiment is to be recognized mainly from FIG. 3, includes deposit plate 14 of L-shaped cross section with rear wall 15.

Figure 2:
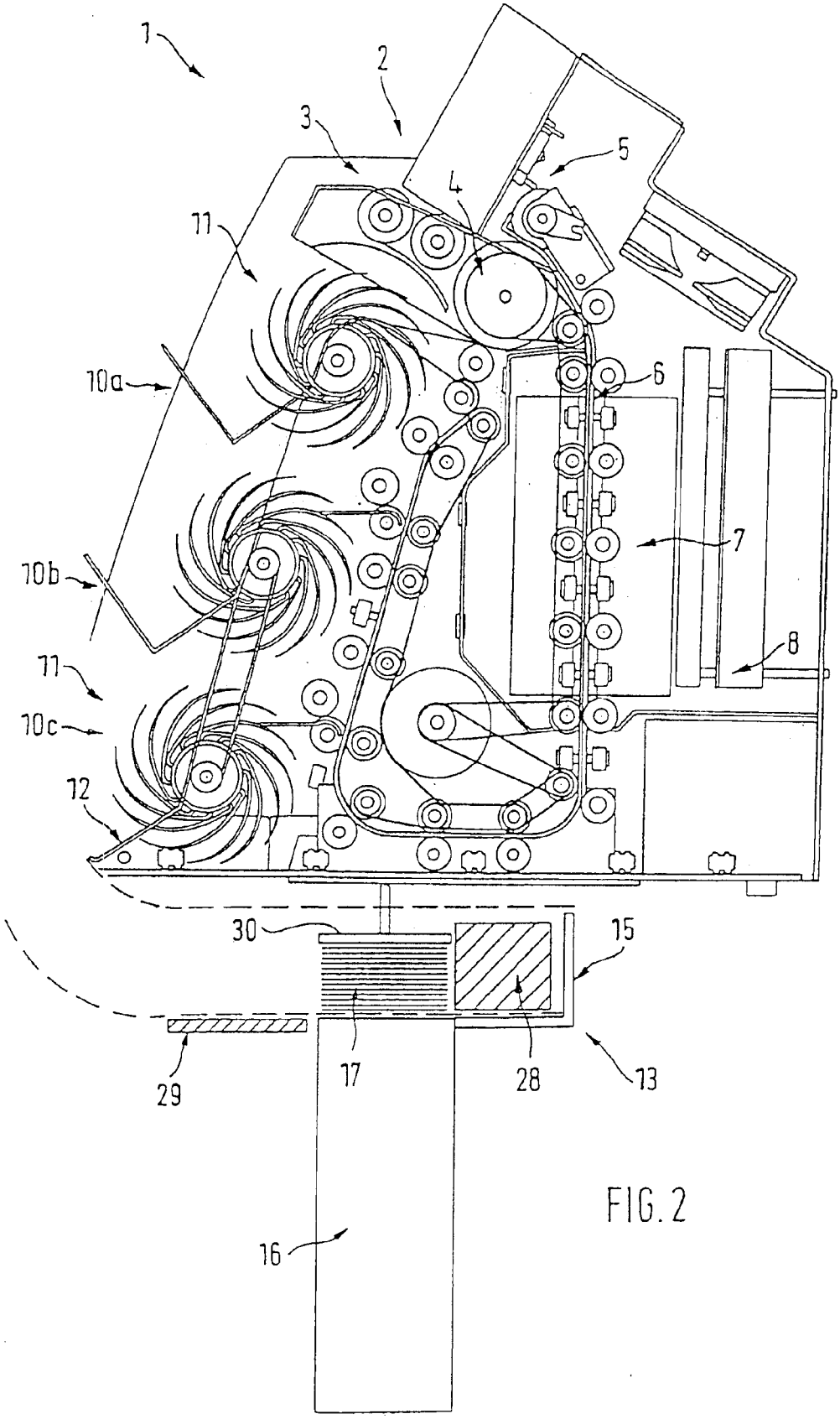
FIG. 2 shows a schematic view of the apparatus according to FIG. 1 in a second operating state.

In addition, stack carrier unit 13 is designed to be movable so that bank notes 17 stacked in stacking device 10*c* on deposit surface 14 can be transported from the first position associated with stacking device 10*c*, which is shown in FIG. 1, to the second position associated with end cashbox 16, which is shown in FIG. 2. The end cashbox may be for example bank-note stacking cassette 16 into which bank notes can be stamped with the aid of stamp 30.

Figure 3:
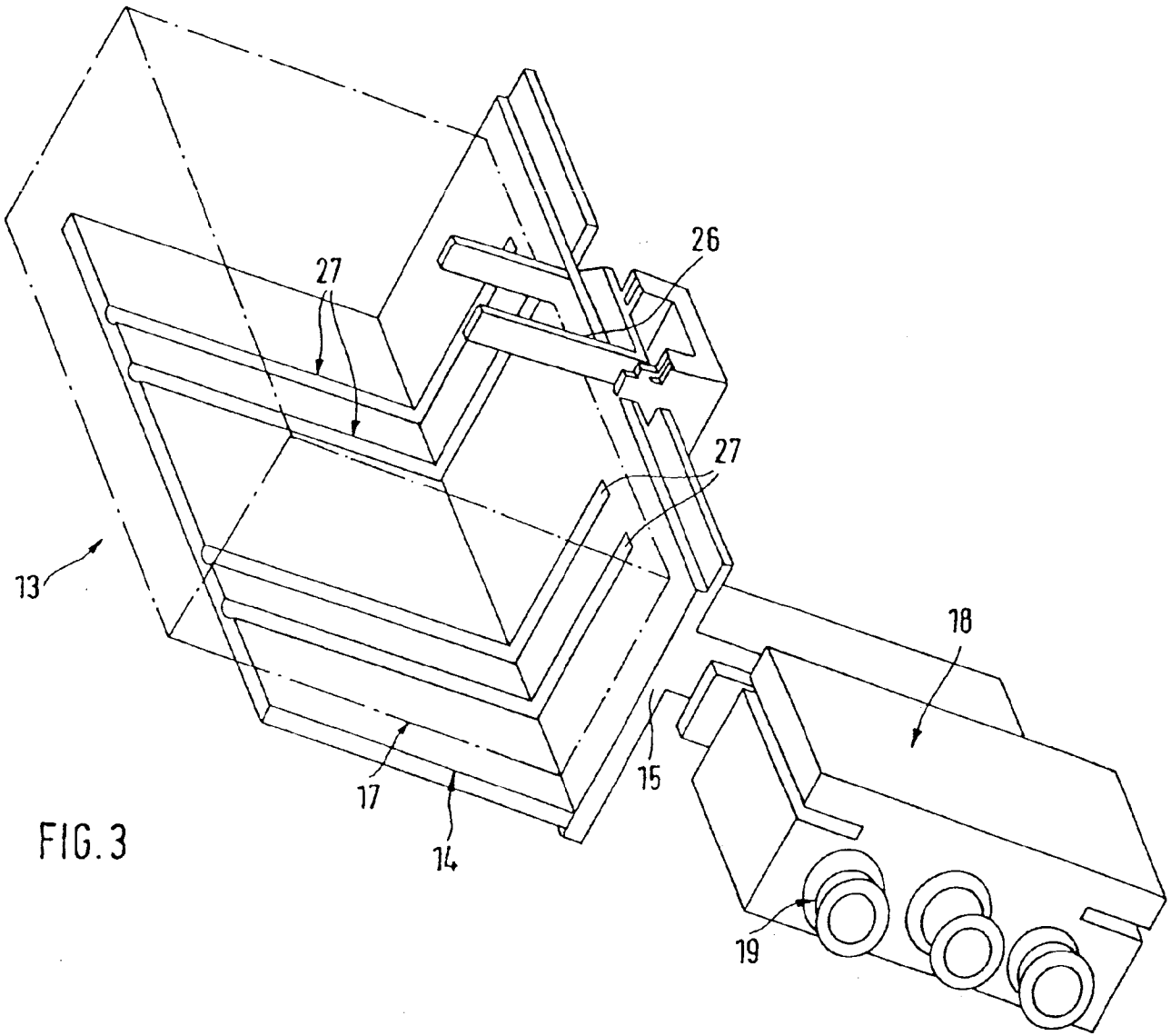
FIG. 3 shows a schematic perspective view of a stack carrier unit according to a first embodiment, which is used in the apparatus according to FIGS. 1 and 2.
Figure 4:
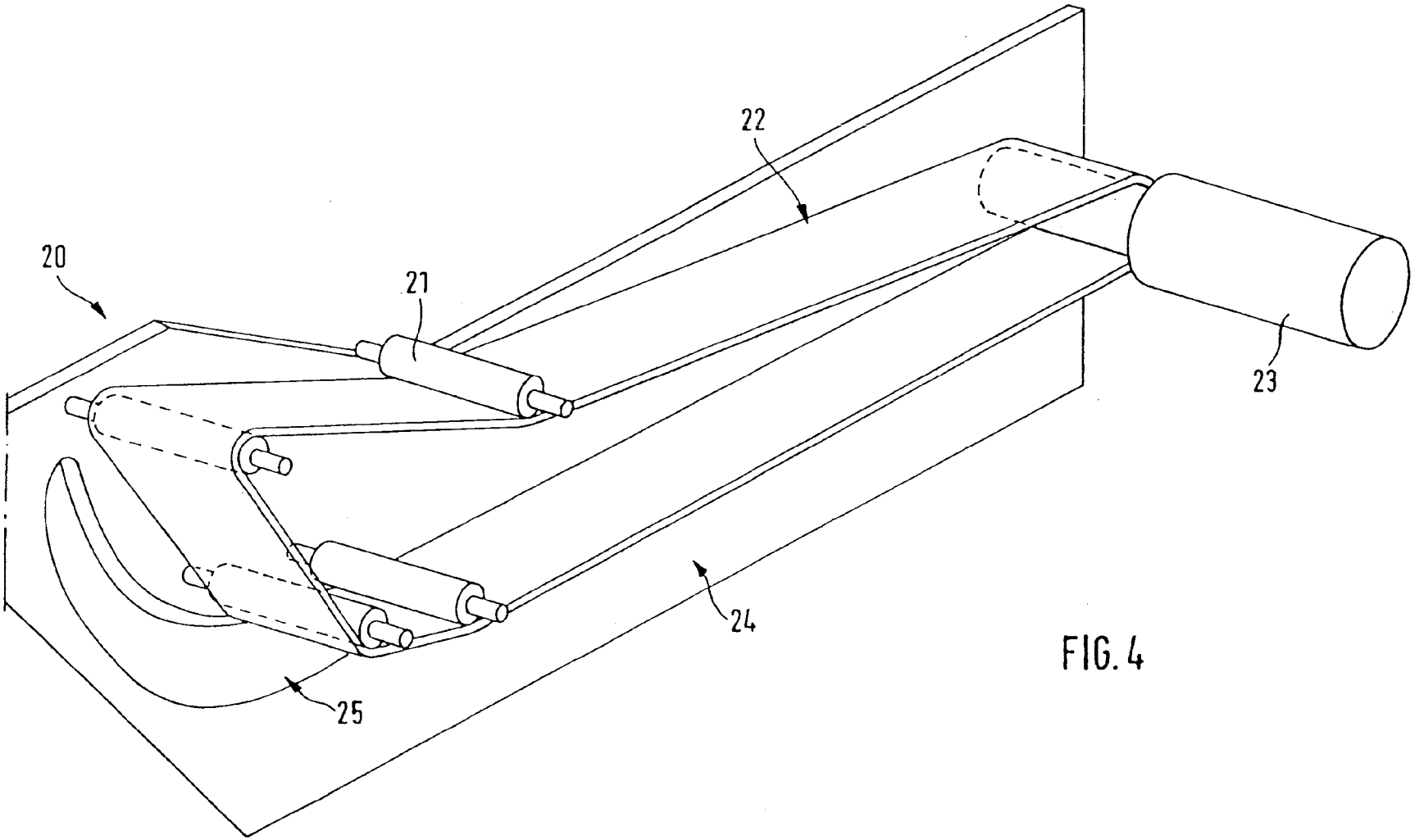
FIG. 4 shows a schematic perspective view of a guide device used in the apparatus according to FIGS. 1 and 2.

The transport or guide mechanism for guided motion of stack carrier unit 13 from the stacking area to the end cashbox area is apparent in particular from FIGS. 3 and 4.

According to FIG. 3, transport slide 18 is firmly mounted laterally in the area of rear wall 15 of approximately L-shaped stack carrier unit 13. The drive of transport slide 18 is effected as a synchronous belt drive in the shown embodiment, because this permits simple deflection of stack carrier unit 13 from the oblique stacking and escrow position according to FIG. 1 to the horizontal end cashbox position according to FIG. 2. The motion of transport slide 18 is thus composed of a curved section and a straight line.

For displacing carrier unit 13 using said transport slide 18, i.e. for transferring bank notes 17 to be stacked from escrow area 13 to end cashbox 16, the guide device further comprises connecting link assembly 20 shown in FIG. 4, which comprises toothed belt 22 in the form of an endless band guided over deflection rollers 21, the drive of toothed belt 22 being regulated by driveshaft 23 with associated motor control. Driveshaft 23 and deflection rollers 21 are rotatably fixed in two parallel and spaced-apart guide rails 24, FIG. 4 showing the rear one of said guide rails. Bushes 19, three of which are present on the front and back of transport slide 18 in each case (FIG. 3 showing only the front three), engage the connecting links, i.e. gaps 25 in front and back guide rails 24, respectively.

To minimize the rolling resistance in connecting link 25, bearing-mounted flanged guide bushes 19 are used, the lateral guide of stack carrier unit 13 being simultaneously effected by said bushes 19. The acting moment on transport slide 18 during transport is taken up by the two guide rails 24. The positioning of stack carrier unit 18 in the stacking position according to FIG. 1 is moreover effected in the end position by holding bolts not shown.

As also apparent from FIG. 3, the stack carrier unit further comprises clamping element 26 mounted on the upper side of rear wall 15. Clamping element 26 consists in particular of two rigidly interconnected clamping fingers 26 that can be rotated out of a plane parallel to rear wall 15 by a variable angular amount to clamp bank notes stacked on deposit surface 14 so as to secure them from slipping.

In FIG. 3, bank-note bundle 17 stacked on deposit surface 14 is shown transparent for clarity's sake. Therefore the four parallel extending linear slots 27 in deposit surface 14 and rear wall 15 are still recognizable.

As will be explained precisely in the following, said slots 27 serve to engage four retaining plates 28 disposed complementary thereto, which are disposed rigidly in the area of end cashbox 16 and serve to retain the bank notes above end cassette 16.

The apparatus according to FIGS. 1 to 4 can be used for example as follows for carrying out a first embodiment of the inventive method.

At the beginning of a transaction by an operator, stack carrier unit 13 is located in the position shown in FIG. 1 with rear wall 15 aligned flush with stripping element 12. Clamping element 26 is disposed parallel to rear wall 15 to permit bank notes to be stacked on deposit surface 14.

The operator now inserts bank notes to be deposited in the apparatus into input pocket 2, the bank notes being supplied singly to checking device 7 and the authenticity and denomination of the bank notes determined there. Nonrecognized reject bank notes are then outputted into output pocket 10*a* and false bank notes or suspected forgeries into further pocket 10*b*.

All other bank notes, i.e. those determined by checking device 7 as authentic and according to their denomination, are stacked by spiral slot stacker 11 on deposit plate 14. Since stack carrier unit 13 is not disposed horizontally, but inclined for example 60° to the horizontal, bank notes are already stacked flush with rear wall 15 when deposited. Bank notes temporarily stored in stack carrier unit 13 serving as an escrow are processed further in one of the two following ways.

If the operator does not agree with the final deposit of bank notes 17 in end cashbox 16 and wants to abort his deposit operation, bank notes 17 are removed from escrow 13 through a cover flap (not shown in the drawings) which is automatically unlocked and opened by control unit 8.

If, on the other hand, the operator agrees with the deposit of bank notes stacked in escrow 16 in end cashbox 13, the cover flap remains locked and stack carrier unit 13 is moved by guide device 20 from the position associated with stacking device 10*c* as shown in FIG. 1 to the position of bank notes 17 associated with end cashbox 16.

Clamping element 26 is thereby first rotated into clamping contact with bank notes 17 stacked on deposit surface 14, and stack carrier unit 13 then moved via connecting link guide 25 by transport slide 18 to a position above cassette 16, whereby cassette cover 29 is already pulled away laterally, as shown in FIG. 2.

In this position, stamp 30, which was located previously during transport of carrier unit 13 in the uppermost, completely moved-in position according to FIG. 1, presses from above on bank notes 17 so that the bank notes are lightly pressed onto deposit surface 14. Then stack carrier unit 13 is displaced further to the right, the bank notes stripped off by meshing engagement of retaining plates 28 with slots 27, so that bank notes 17 remain positioned above end cashbox 16, while stack carrier unit 13 is moved further to the end position shown in FIG. 2.

Stamp 30 now moves downward, as shown in FIG. 2, and urges bank notes 17 into cassette 16. The base surface in cassette 16 on which bank notes 17 are now stacked is at the same time displaced downward in cassette 16 for example by an actuator. Displacement can be effected not by an actuator but e.g. also by a spring element coupled with the base surface.

Then the stamp is pushed back upward to its starting position and stack carrier unit 13 transported from the position shown in FIG. 2 back to the position according to FIG. 1, so that a new cash deposit operation can begin. Cover 29 is usually displaced laterally onto the cassette opening to close cassette 16 not after each cash deposit operation but only immediately before a change of cassette or in case of a disturbance to prevent access to bank notes contained therein.

Figure 5:
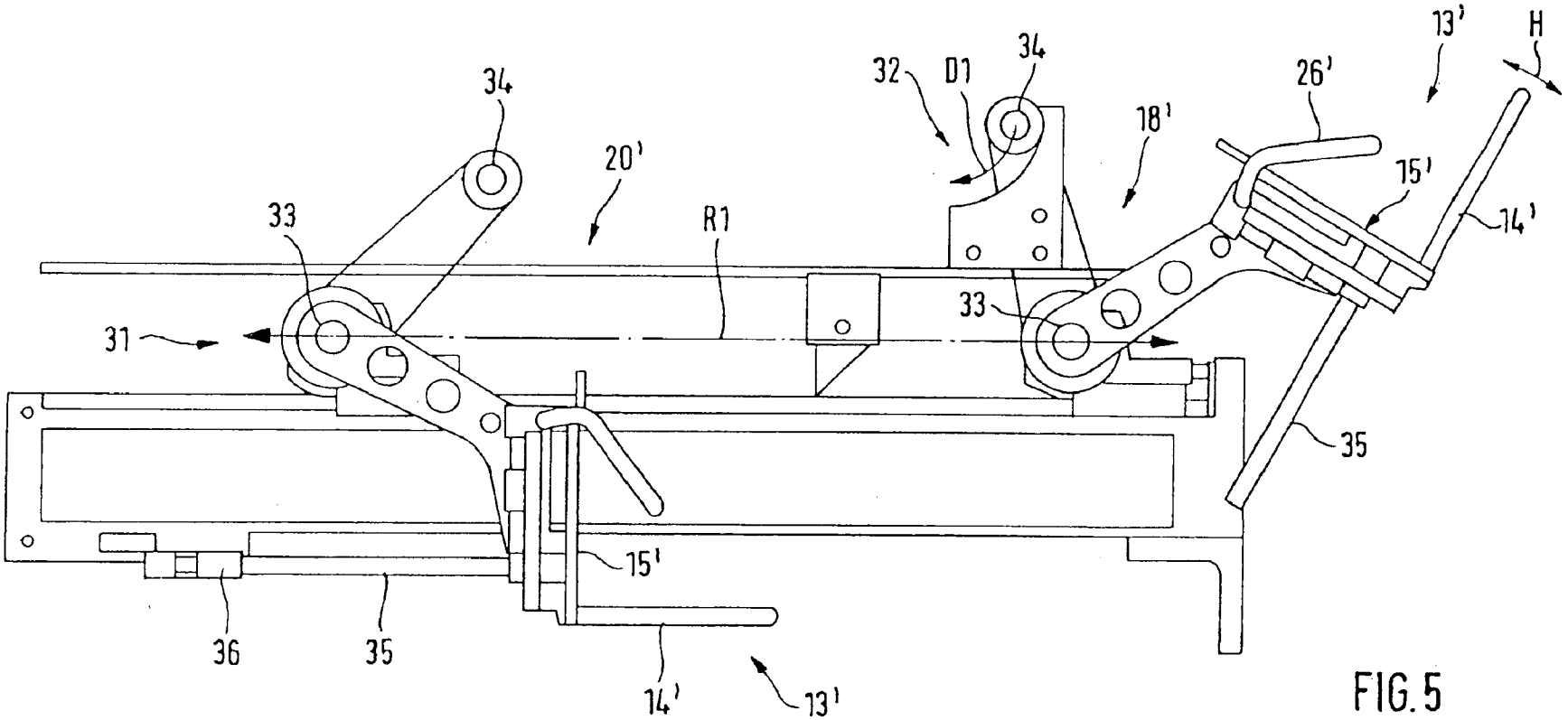
FIG. 5 shows a schematic cross-sectional view through a stack carrier unit according to a second embodiment of the present invention.
Figure 6:
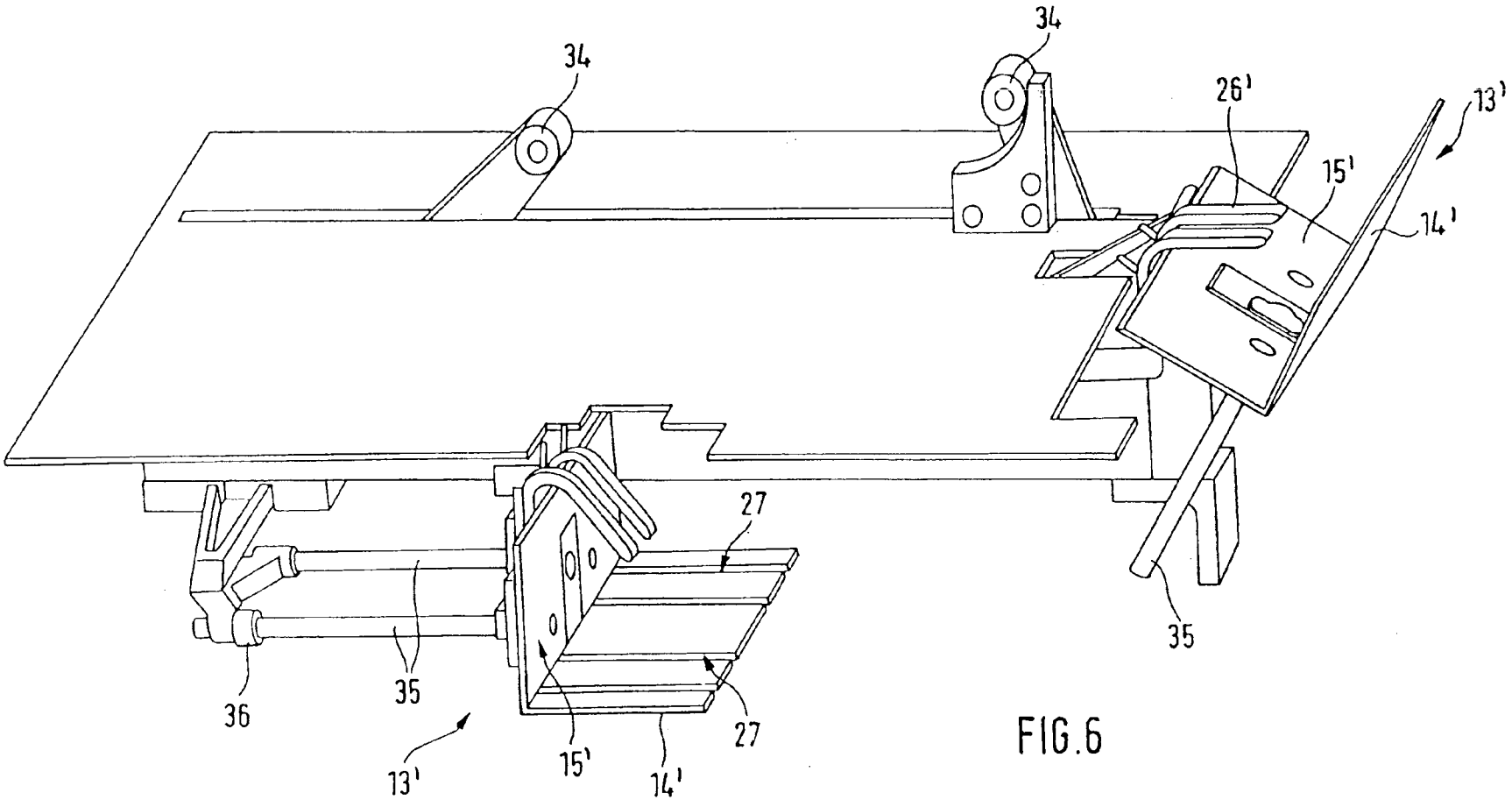
FIG. 6 shows a schematic perspective view of the apparatus component according to FIG. 5.

A second embodiment is shown by way of example in FIGS. 5 and 6, which show schematically a side view and perspective view from obliquely above of stack carrier unit 13' with an associated transport system for transporting stacked bank notes from the stacking position to the end cashbox position.

Said stack carrier unit 13' can be used e.g. in the apparatus according to FIGS. 1 and 2 instead of the transport system with a connecting link guide shown in FIGS. 3 and 4, whereby the representation of apparatus components according to FIGS. 5 and 6 is of course to be imagined laterally reversed when they are used in the apparatus according to FIGS. 1 and 2.

The right side of FIGS. 5 and 6 shows likewise approximately L-shaped stack carrier unit 13' with deposit surface 14' and rear wall 15' on which bank notes are deposited temporarily by spiral slot stacker 11. In addition, two rigidly interconnected clamping fingers 26' are rotatably fastened on the upper side of rear wall 15', said fingers being slightly curved so that the bank-note bundle stacked on deposit surface 14' can be easily clamped even if the bundle height is small.

The apparatus components according to FIGS. 5 and 6 further differ from those according to FIGS. 3 and 4 in particular in the design of the guide device for moving stack carrier unit 13' from the stacking position shown on the right in the drawings to the position associated with the end cashbox shown on the left in the drawings for inserting bank notes into stacking cassette 16. It should be noted that FIGS. 5 and 6 thus do not illustrate two different stack carrier units 13' that are simultaneously present, but only one single stack carrier unit 13' in two different states.

For transferring stack carrier unit 13' from the right-hand stacking position to the left-hand position associated with end cassette 16, stack carrier unit 13' or associated transport slide 18' is moved back and forth on linear rail 31 actively with connecting link actuated swivel attachment 32.

Therefore, transport slide 18' comprises first axle 33 rigidly connected with rear wall 15' and rotatably connected with second axle 34 spaced therefrom. As apparent in particular from FIG. 5, a secure, force-guided transport of stack carrier unit 13' between stacking position and end cashbox position can thus be realized by a motion guided with the aid of linear rail 31 linearly along line R1 in combination with the swiveling displacement of second axle 34 through connecting link actuated swivel attachment 32 along direction of rotation D1.

A further difference over stack carrier unit 13 according to FIGS. 1 to 4 is that the stripping off of bank notes in the horizontal position above end cassette 16 is not realized by engagement of stripping plates 28 in associated longitudinally extending slots 27 as in FIGS. 2 and 3, but by deposit surface 14' being pulled away, in this position associated with the end cashbox as shown on the left in FIGS. 5 and 6, laterally to the left meshing below rear wall 15' held rigidly there.

For this purpose, two pins 35 recognizable mainly in FIG. 6 are mounted on the back of rear wall 15' to push against associated retaining elements 36 in the position associated with the end cashbox where bank notes stacked on deposit surface 14' are located immediately above the cassette opening.

In this state shown in FIGS. 5 and 6, rear wall 15' and thus bank notes 17 stacked flush therewith are therefore held fast, while deposit surface 14' firmly connected with axle 33 is pulled away meshing under bank-note bundle 17 further to the left.

Figure 7:
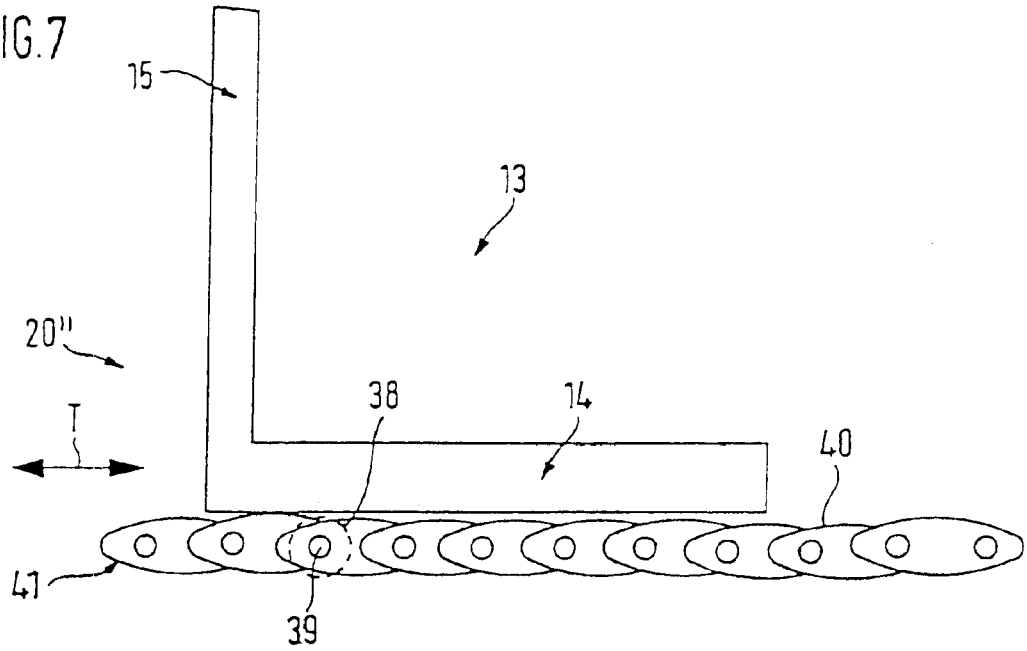
FIG. 7 shows a schematic cross-sectional view of a part of an apparatus according to a third embodiment.
Figure 8:
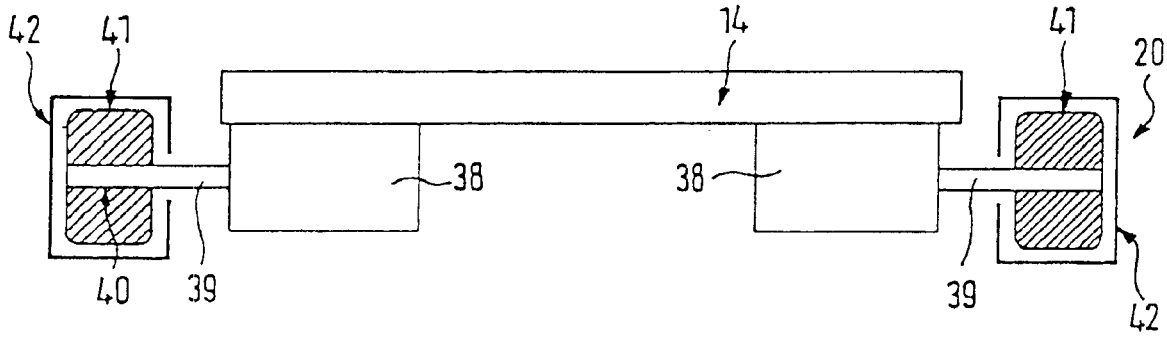
FIG. 8 shows the apparatus according to FIG. 7 in a view perpendicular to the representation according to FIG. 7.

A third embodiment of an inventive apparatus is illustrated by the representations of FIGS. 7 and 8. In this embodiment, a chain transport system is used as guide device 20" for force-guided transport of stack carrier unit 13. The use of such a chain transport system has the particular advantage that it can be realized in space-saving fashion because it does not have to protrude far beyond the area of stack carrier unit 13.

For this purpose, the underside of deposit surface 14 of stack carrier unit 13 is connected at each of two end areas located in a direction perpendicular to transport direction T with bolt 38 whose radially outwardly protruding guide pins 39 engage hole 40 in chain 41. As apparent from FIG. 8, chain 41 is mounted in each case in dimensionally stable bearing housing 42 with a somewhat C-shaped cross section so that the transport path of stack carrier unit 13 can be fixed by the form of bearing housing 42 in particular in transport direction T.

For displacing chain 41, the latter is connected in an area located outside the transport path from the first to the second position with a motor that pushes chain 41 back and forth for transporting stack carrier unit 13 between the first and second positions.

Some embodiments have been described hereinabove. Numerous variations are of course conceivable, a few of which will be described by way of example hereinafter.

In the third embodiment, stack carrier unit 13 can e.g. not only be connected rigidly with bolt 38 but preferably also mounted pivotally around said bold. This can be used for rotating stack carrier unit 13 in defined fashion to an e.g. exactly fitting position for inserting bank notes into the end cassette independently of the course of the guide device.

While the height of deposit surface 14, 14' was fixed with respect to rear wall 15, 15' in the above-described embodiments, the position, i.e. height, of deposit surface 14' is preferably variable. That is, as indicated by double arrow H in FIG. 5, deposit surface 14, 14' is displaced in height H for example passively by a spring or actively by an associated actuator.

This has the advantage that bank notes 17 are always deposited approximately in the same height position on any previously stacked bank notes in stacking area 13 so as to guarantee reliable stacking.

The case was moreover described hereinabove of cassette 16 being installed vertically in the housing of apparatus 1 so that bank notes are oriented horizontally on deposit surface 14, 14' above the cassette opening to be stamped into cassette 16. When deposit surface 14, 14' is pulled away in this position, the bank-note stack might tilt since only an increasingly smaller partial surface of the stack is resting directly on deposit surface 14, 14'.

To avoid this, the cassette will preferably be inserted in the housing of the automatic teller obliquely, e.g. inclined 10 to 15° to the horizontal, so that deposit surface 14, 14' can be pulled away directed obliquely downward under bank notes 17 stacked thereon. This leads to a reduction of the effective torque acting on the bank notes when deposit surface 14, 14' is pulled away, thereby reducing the danger of tilting when the deposit surface is pulled away.

It should be emphasized that this principle of obliquely aligning cassettes into which e.g. bank notes are inputted from above can also be used advantageously independently of the above-described inventive systems to prevent tilting when a deposit surface, cassette cover or the like is pulled away upon insertion of bank notes into the cassette.

Further, the stack carrier unit need not be moved from the stacking position to the end cashbox position in passively driven fashion, as was the case in the above embodiments. Alternatively it is also possible for the stack carrier unit itself to comprise a motor control or the like for moving the stack carrier unit on a given path in actively driven fashion. Thus, the stack carrier unit could comprise motor-driven rollers running on a guide rail.

Figure 9:
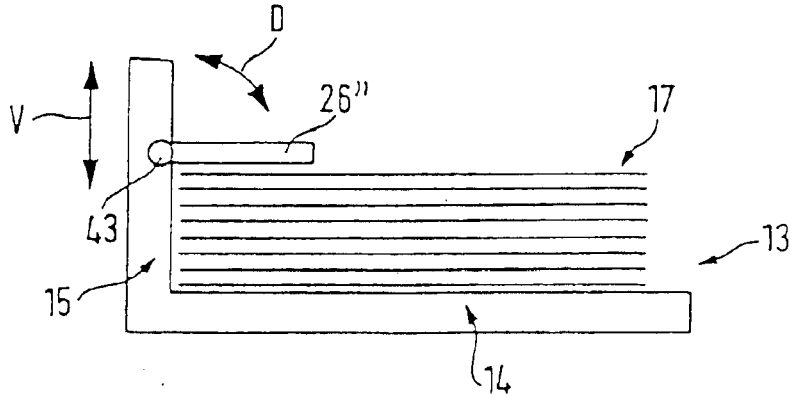
FIG. 9 shows a schematic representation of a clamping element for use in an inventive apparatus.

As shown in FIG. 9, clamping element 26" for clamping bank notes 17 stacked on deposit surface 14 can not only be mounted pivotally around axle 43. It is also conceivable for clamping element 26" to be additionally mounted to be displaceable vertically in direction V in rear wall 15 of stack carrier unit 13, so that after stacking of bank notes 17 clamping fingers 26" are first urged around axle 43 into a plane parallel to bank notes 17 and then in direction V onto bank notes 17.

Alternatively, the clamping element can also be moved horizontally into the stacking area and then urged vertically in direction V onto bank notes 17. These variations permit a clamping process without crumpling the bank notes.

The inventive apparatus and method thus permit bank notes to be transported securely from a stacking area to the end cashbox.

What is claimed is:

1. An apparatus for inputting bank notes and depositing all or at least a portion of the inputted bank notes, having a checking device for checking at least one bank-note property of inputted bank notes, a stacking device for temporarily storing individual or a plurality of bank notes checked by the checking device, and an end cashbox for depositing bank notes temporarily stored in the stacking device, a part of the stacking device being a stack carrier unit having a deposit surface on which bank notes can be deposited, and the stack carrier unit being adapted to be moved such that bank notes temporarily stored in the stacking device can be transported from a first position associated with the stacking device to a second position associated with the end cashbox, characterized in that bank notes can be urged out of the second position of the stack carrier unit into the end cashbox.

2. An apparatus according to claim 1, characterized in that the deposit surface comprises a plate, grid or finger structure on which bank notes can be deposited in the stacking device singly or in bundles.

3. An apparatus according to claim 1, characterized by a clamping element connected with the stack carrier unit and/or adapted to be adjusted, e.g. displaced and/or swiveled, with respect to the stack carrier unit, for holding bank notes on the stack carrier unit in clamped fashion.

4. An apparatus according to claim 3, characterized by a control device that drives the damping element such that the clamping element is moved to a bank-note clamping position after all bank notes to be transported from the first to the second position in a transport process have been stacked in the stack carrier unit.

5. An apparatus according to claim 1, characterized by a stamp element for stamping bank notes located in the second position into a cassette serving as an end cashbox.

6. An apparatus according to claim 1, characterized by an adjusting unit connected with the deposit surface for changing the position of the deposit surface in the first position associated with the stacking device in dependence on the number of banknotes stacked and/or to be stacked on the deposit surface.

7. An apparatus according to claim 1, characterized in that the deposit surface is inclined to the horizontal in the first and second positions or inclined to the horizontal in the first position and disposed substantially horizontally in the second position.

8. An apparatus according to claim 1, characterized in that the deposit surface can be displaced in the second position such that bank notes are released to permit bank notes stacked on the deposit surface to be deposited in the end cashbox.

9. An apparatus according to claim 1, characterized by a guide device connected with the stack carrier unit for permitting the stack carrier unit to be moved in force-guided fashion from the first position associated with the stacking device to the second position associated with the end cashbox and/or from the second to the first position.

10. An apparatus according to claim 9, characterized in that the guide device comprises a rail guide, belt guide, chain guide and/or connecting link guide.

11. An apparatus according to claim 9, characterized in that the guide de-vice is adapted to be driven such that a driveless stack carrier unit is moved passively or the stack carrier unit comprises an active drive, such as a motor drive, for permitting the stack carrier unit to be moved actively in an area given by the guide device.

12. A method for inputting bank notes and depositing all or at least a portion of the inputted bank notes in an end cashbox, whereby after a check of at least one bank-note property of inputted bank notes said notes are temporarily stored in a stacking device singly or in bundles, checked bank notes being deposited for temporary storage on a deposit surface of a stack carrier unit, and the stack carrier unit then being moved such that bank notes temporarily stored in the stacking device are transported from a first position associated with the stacking device to a second position associated with the end cashbox, characterized in that bank notes are urged out of the second position into the end cashbox.

13. A method according to claim 12, characterized in that bank notes are clamped so as to be fixed against slipping after all bank notes to be transported from the first to the second position in a transport process have been stacked in the stacking device.

14. A method according to claim 12, characterized in that in the second position the deposit surface of the stack carrier unit is displaced with respect to the bank notes stacked thereon so that said notes can then be deposited in the end cashbox.

15. A method according to claim 14, characterized in that bank notes remain fixed in the second position by a retaining element in the step of displacing the deposit surface.

* * * * *